US006036085A

United States Patent [19]

Tsao

[11] Patent Number: 6,036,085

[45] Date of Patent: Mar. 14, 2000

[54] PORTABLE FOOD CONTAINER HAVING SIDEWARD OPENABLE ACCESS

[76] Inventor: Chung-Piao Tsao, 4F, No. 22, Lane 346, Kuang-Fu S. Road, Taipei, Taiwan

[21] Appl. No.: 09/264,543

[22] Filed: Mar. 5, 1999

[51] Int. Cl.[7] ..... B65D 5/46; B65D 5/00; B65D 17/00

[52] U.S. Cl. ..... 229/117.14; 229/122; 229/230; 229/161

[58] Field of Search ..... 229/200, 117.14, 229/117.15, 122, 230, 161

[56] References Cited

U.S. PATENT DOCUMENTS

| | | | |
|---|---|---|---|
| 2,648,480 | 8/1953 | Belsinger | 229/122 |
| 2,721,022 | 10/1955 | Billerbeck | 229/122 |
| 3,339,820 | 9/1967 | Kryzanowski | 229/117.14 X |
| 3,835,989 | 9/1974 | Mori et al. | 229/160.2 X |
| 4,399,939 | 8/1983 | Tunick | 229/117.14 |
| 5,275,331 | 1/1994 | Piao | 229/117.14 X |
| 5,957,276 | 9/1999 | Cutler et al. | 229/117.14 X |

FOREIGN PATENT DOCUMENTS

| | | | |
|---|---|---|---|
| 533457 | 3/1993 | European Pat. Off. | 229/117.14 |
| 1031438 | 6/1953 | France | 229/117.14 |

*Primary Examiner*—Gary E. Elkins
*Assistant Examiner*—Tri M. Mai

[57] ABSTRACT

A portable food container includes: a side cover hingedly secured to a side wall of a box stored with foods in the box, with the side cover easily openable from a side portion of the box for an easy access into the interior of the box for conveniently taking foods outwardly through a side opening formed in the side wall even though the box is being carried by a user's hand, whereby upon recovery of the side cover, the container will be instantly closed conveniently.

6 Claims, 5 Drawing Sheets

PORTABLE FOOD CONTAINER HAVING SIDEWARD OPENABLE ACCESS

BACKGROUND OF THE INVENTION

U.S. Pat. No. 5,275,331 of Foldable Container issued to the same inventor of this application provides a container having two side-wing members (14) interlocked to serve as a handle for carrying foods or the like as stored in the container and two half covers (18) for shielding a top opening of the container. For eating food as stored in the container, the container should be temporarily placed on a table and the two half covers (18) are then opened for taking foods outwardly from the container. It is impossible to eat food when carrying the container by interlocking the two side-wing members 14 (FIG. 15 of the prior art) and retarding the opening of the two covers (18).

The present inventor has invented a portable food container which is sideward openable and accessible even when carried by a hand.

SUMMARY OF THE INVENTION

The object of the present invention is to provide a portable food container including: a side cover hingedly secured to a side wall of a box stored with foods in the box, with the side cover easily openable from a side portion of the box for an easy access into the interior of the box for conveniently taking foods outwardly through a side opening formed in the side wall even though the box is being carried by a user's hand, whereby upon recovery of the side cover, the container will be instantly closed conveniently.

DETAILED DESCRIPTION

Figure 1:
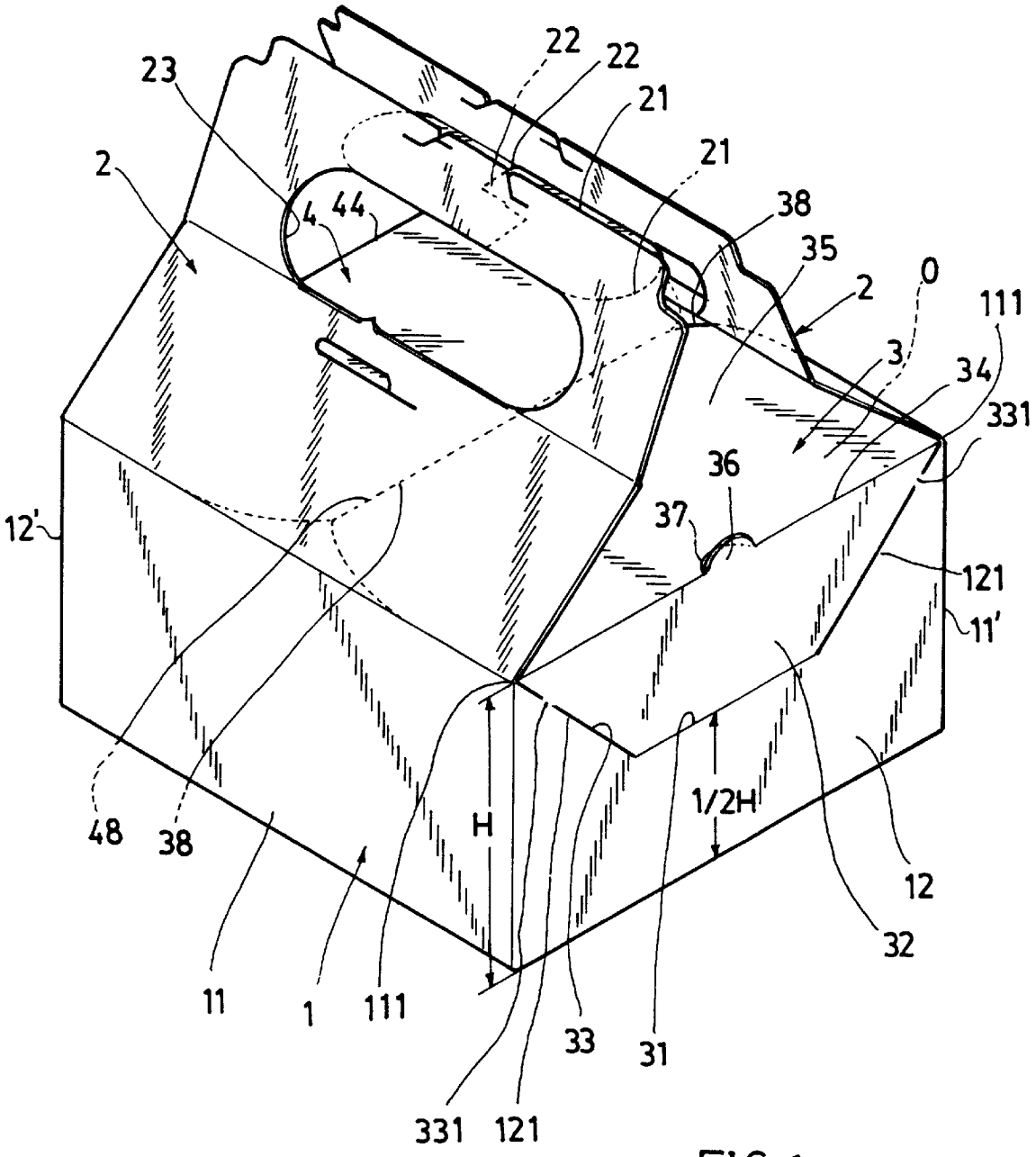
FIG. 1 is a perspective view of the present invention when closed.

As shown in FIGS. 1–6, the present invention comprises: a box 1 having a front wall 11, a rear wall 11', a right-side wall 12 and a left-side wall 12' erected from a bottom wall 13; two handle members 2,2 respectively protruding upwardly from the front wall 11 and the rear wall 11'; a side cover 3 hingedly secured to the right-side wall 12; and a top cover 4 hingedly secured to the left-side wall 12, with the top cover 4 and the side cover 3 cooperatively closing an opening O defined among the front wall 11, the rear wall 11' and the two side walls 12,12'.

Each handle member 2 includes: a flaps 21 cut out in the handle member 2 to form a hand hole or finger hole 23 for passing a user's hand or fingers therethrough, and a locking tab 22 formed on each flap 21 by cutting a slit in a central portion of the flap 21, whereby upon interlocking of the two flaps 21 of the two handle members 2 by engaging the two locking tabs 22 together, the two handle members 2 will be combined and locked to serve as a handle to carry the container having foods F stored therein. The interlocking of the two flaps may be referred to the prior art such as disclosed in U.S. Pat. No. 5,275,331.

The side cover 3 includes: a side-wall portion 32 hingedly secured to the side wall 12 (such as the right-side wall) of the box 1 along a hinge line 31 formed on a boundary between the side-wall portion 32 and the side wall 12, and a top lid 35 hingedly secured to the side-wall portion 32 along a folding line 34 parallel and opposite to the hinge line 31 of the side-wall portion 32 having an inner edge 38 formed on a free edge of the top lid 35, whereby upon an inward folding of the top lid 35 to be frictionally clamped between the two handle members 2,2 when interlocked together (FIG. 1) and allowing matching of the inner edge 38 of the top lid 35 with an edge 48 of the top cover 4 hingedly secured to and inwardly folded from the other side wall 12' (such as the left-side wall) along another (or left-side) folding line 44 horizontally defined between the front wall 11 and the rear wall 11', the opening O of the box 1 will be closed, wherein the side opening O' has been closed by the side-wall portion 32 of the side cover 3.

The foods F may then be well stored within the container for takeaway service from a food or snack shop.

The side-wall portion 32 of the side cover 3 may be directly punched off from the side wall 12 of the box 1 along two cutting lines 121 formed in opposite side portions of the side wall 12, whereby upon severing of the side-wall portion 32 from the side wall 12 of the box 1, the side-wall portion 32 of the side cover 3 will form opposite side edges 33 defined between the hinge line 31 and the folding line 34, with each side edge 33 inclined upwardly outwardly towards a folding line 111 between each each front wall 11 or rear wall 11' and each handle member 2 when folding the side cover 3 to close the opening O of the box 1 (FIG. 1).

The side-wall portion 32 of the side cover 3 has the opposite side edges 33 each partially linked with the side wall 12 of the box 1 at a short unbroken portion 331 as shown in FIG. 1 when the box 1 is new or fresh served, with the short unbroken portion 331 easily torn or broken after first use of the box 1. This design of such a short unbroken portion 331 may help form a stable container before being stored with foods therein. Once used, the unbroken portion 331 may be quickly easily torn and broken when sideward pulling the side cover 3 for opening the cover 3 for taking foods away from the box 1 (FIG. 2, 4).

Figure 2:
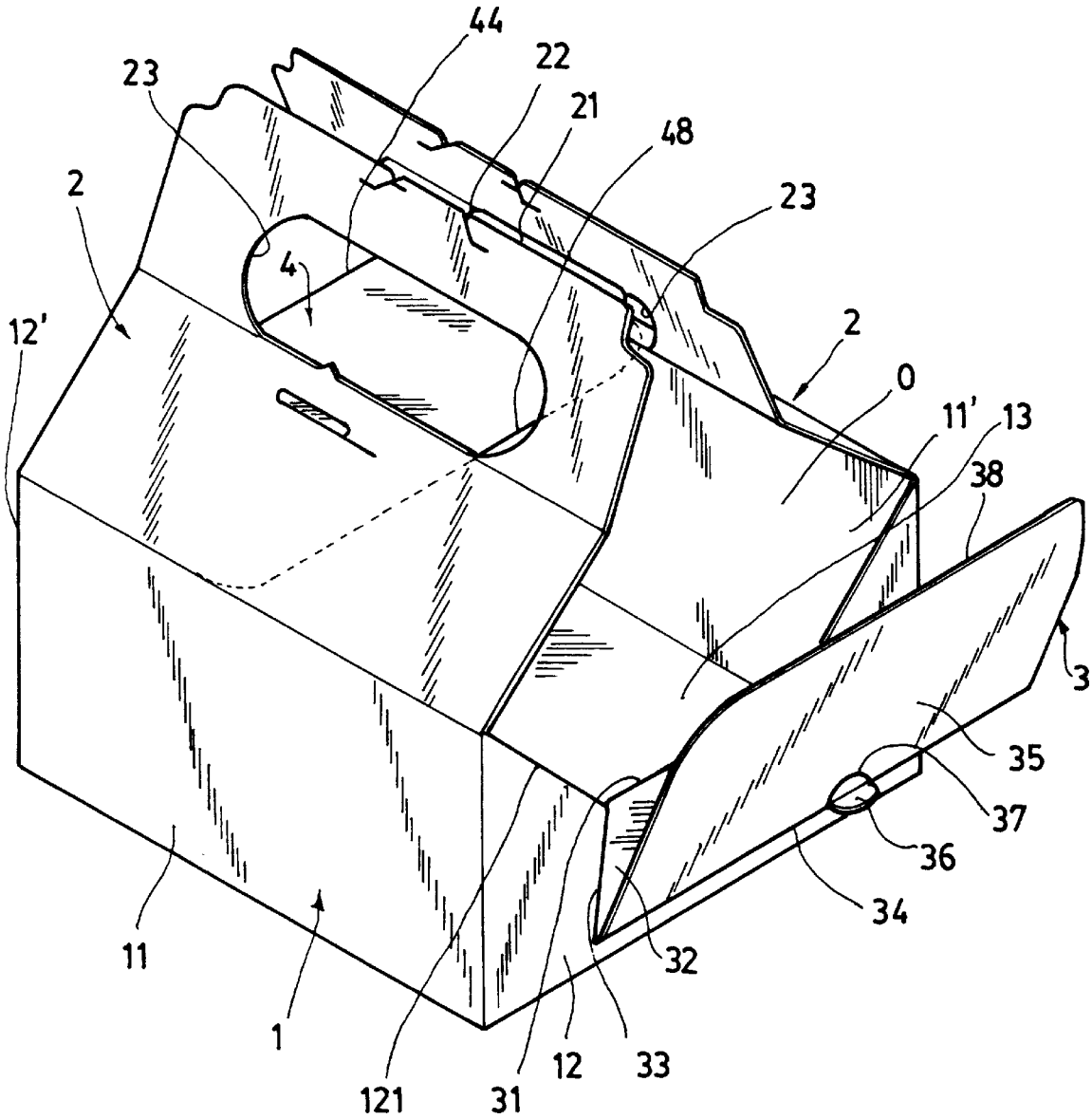
FIG. 2 shows a sideward opened container of the present invention.
Figure 3:
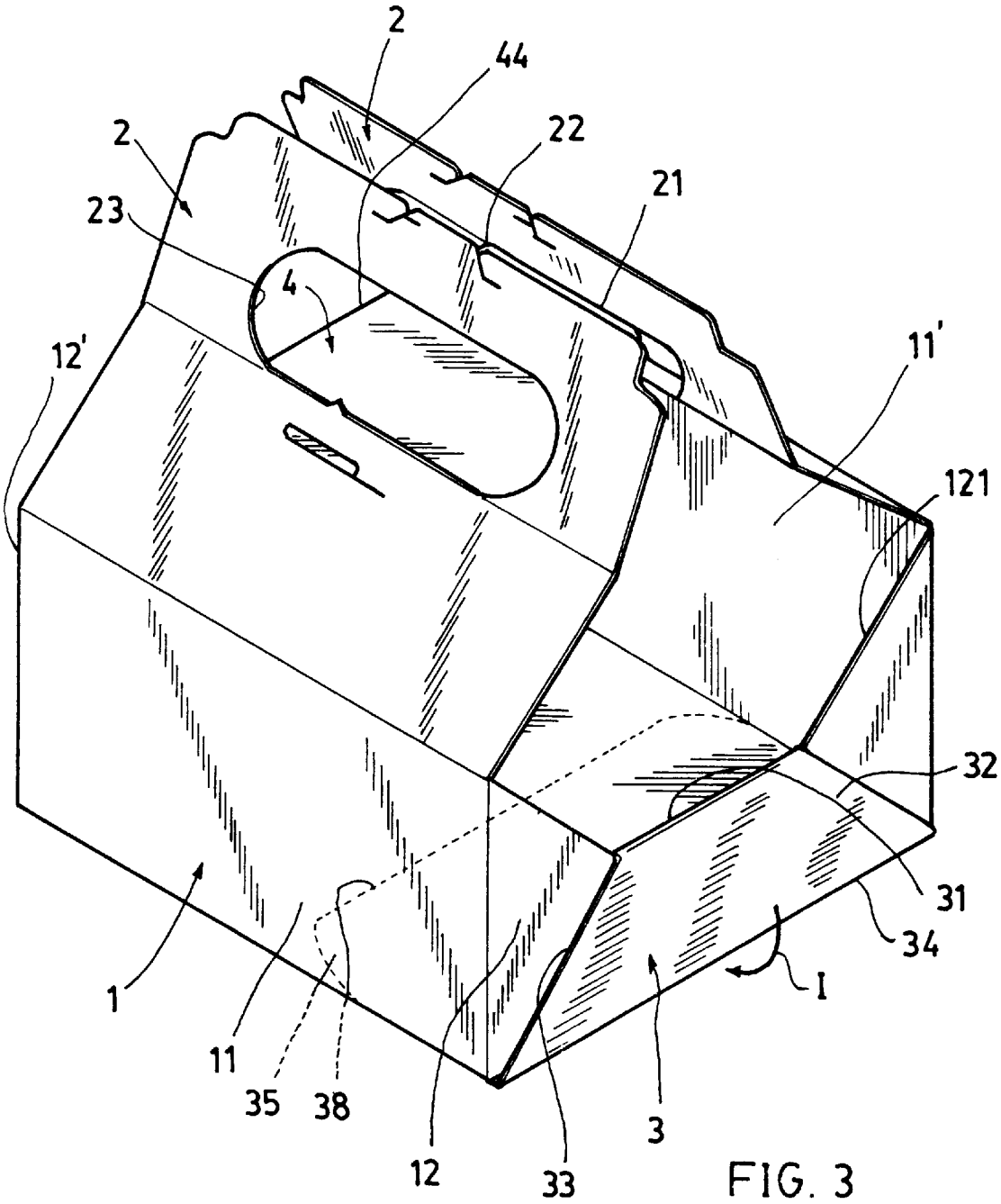
FIG. 3 shows an inversion of the side cover of the present invention to be overlain by the container for stably opening the side cover.
Figure 4:
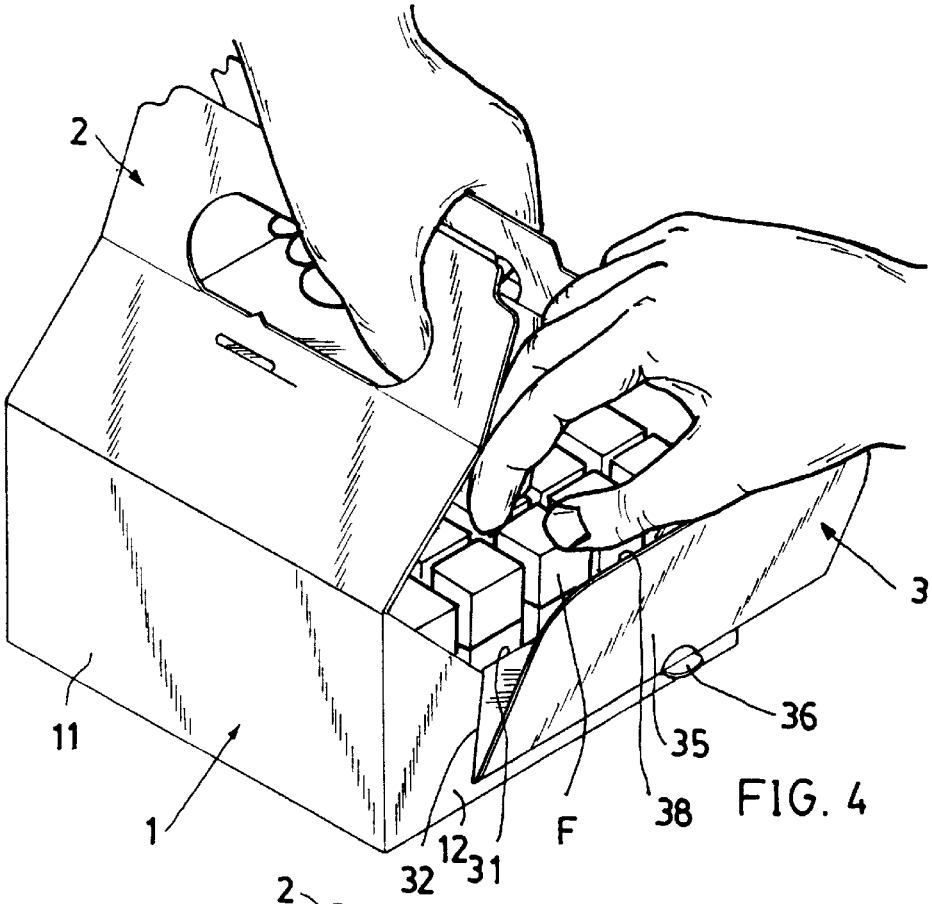
FIG. 4 is an illustration showing taking food away from the sideward opened container as shown in FIG. 2.
Figure 5:
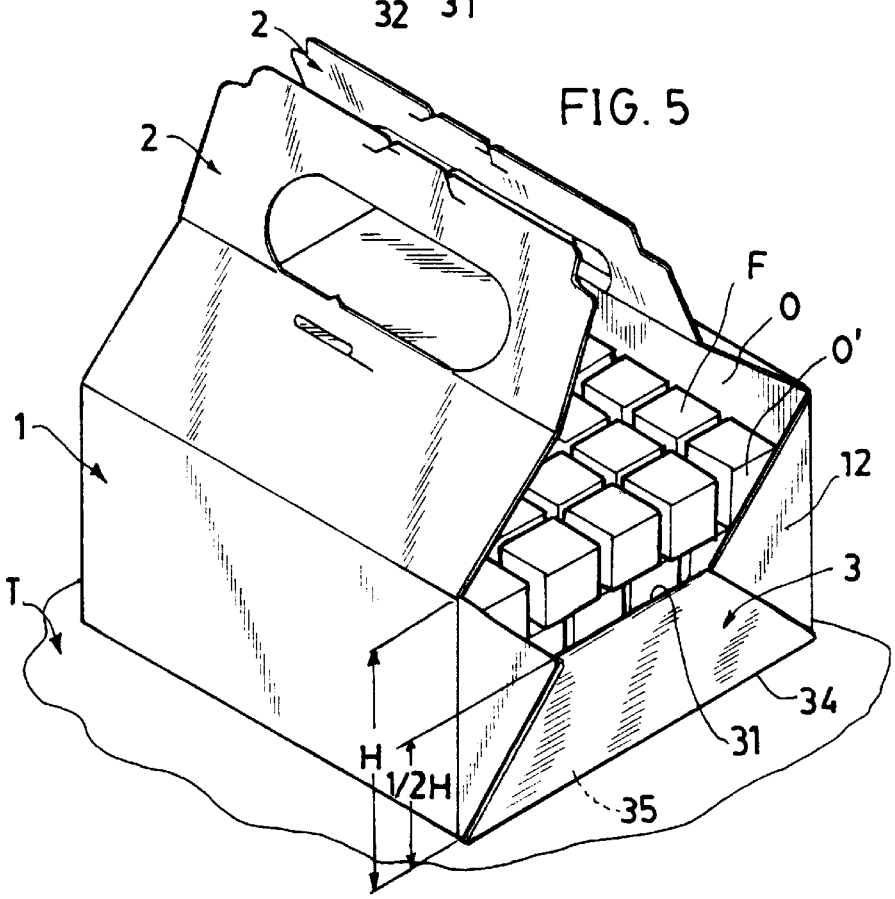
FIG. 5 shows the sideward opened container stored with foods therein.

The side cover 3 is formed with a pulling tab 36 adjacent to the folding line 34 between the side-wall portion 32 and the top lid 35, whereby upon pulling of the tab 36, the side cover 3 will be pulled sidewardly to open the box for an easy access into the interior for taking foods F outwardly for a quick eating purpose (FIGS. 2, 4).

The pulling tab 36 is directly cut out from the side cover 3 to form a tab hole 37 in the side cover 3.

Figure 6:
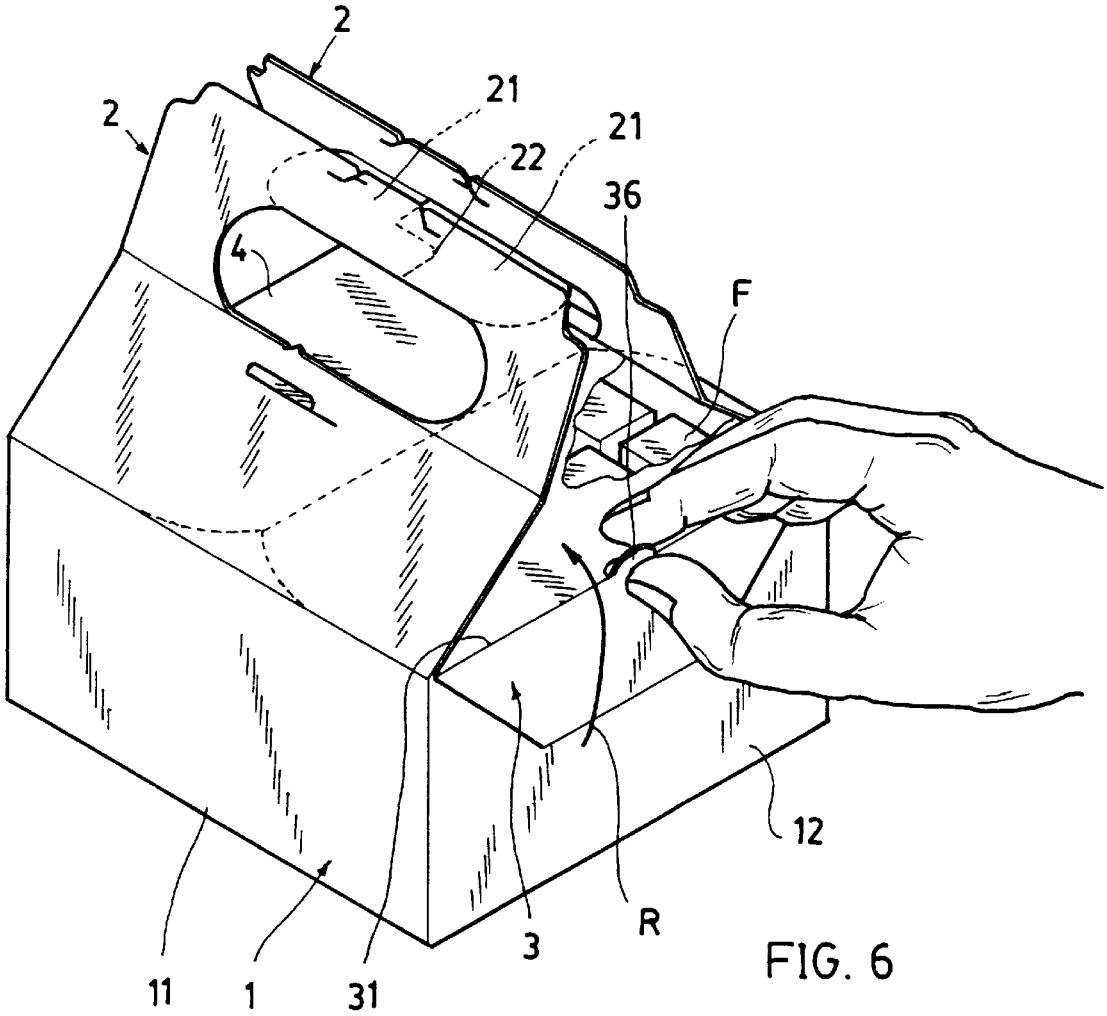
FIG. 6 shows reclosing of the side cover of the present invention.

Upon recovery of the side cover to insert the top lid 35 inwardly (R) as shown in FIG. 6, the box 1 will be re-closed for well storing the foods F within the container.

The height (½H) between the hinge line 31 and the folding line 34 of the side-wall portion 32 is half of the height (H) of the side wall 12 (FIG. 5, 3), whereby upon inversion (I) of the top lid 35 to be overlain under the bottom wall 13 of the box 1, the side cover 3 is stably unfolded for opening of the box for supplying foods smoothly and conveniently when the container is placed on a table T.

The container of the present invention may be made of paper board or other suitable materials. The shapes and structures are not limited in this invention. Even though there is no flap 21 formed in each handle member 2, the handle member 2 may just be simply cut out to form a handle hole for carrying purpose.

The present invention provides a portable food container, whereby even when carrying the container by a user's hand, the box can be easily quickly opened by sidewardly opening the side cover 3 for an instant access into the container for conveniently taking foods outwardly, without influencing the carrying of the container. Afterwards, the side cover 3 may be "re-set" to re-close the opening of the box for continuously storing foods F in the container.

The present invention may be modified without departing from the spirit and scope of this invention.

I claim:

1. A portable food container comprising:

a box having of a bottom wall, a front wall and a rear wall respectively erected from a front and a rear side of the bottom wall, and a right side wall and a left side wall respectively erected from a right side and a left side of the bottom wall;

two handle members respectively protruding upwardly from the front wall and the rear wall, said two handle members combined to be a handle for carrying the box; a side cover and a top cover respectively hingedly secured to said two side walls and operatively folded for closing an opening of the box for storing foods in said box;

the improvement which comprises:

said side cover including: a side-wall portion hingedly secured to the right side wall of the box along a hinge line formed on a boundary between the side-wall portion and the side wall, and a top lid hingedly secured to the side-wall portion along a right folding line parallel and opposite to the hinge line of the side-wall portion, said top lid having an inner edge formed on a free edge of the top lid, whereby upon an inward folding of the top lid to be frictionally clamped between the two handle members when interlocked together and allowing matching of the inner edge of the top lid with an edge of the top cover hingedly secured to the left side wall along a left folding line horizontally defined between the front wall and the rear wall, when said box is in a closed position, said side cover operatively pulled sidewardly for opening said box for an easy access into the interior of said box.

2. A portable food container according to claim 1, wherein said side-wall portion of the side cover is directly punched off from the right side wall of the box along two cutting lines formed in opposite side portions of the right side wall, whereby upon severing of the side-wall portion from the right side wall of the box, the side-wall portion will form opposite side edges defined between the hinge line and the right folding line, with each side edge inclined upwardly and outwardly towards a folding line between each of said front wall and said rear wall and each of said handle members when folding the side cover to close the opening of the box.

3. A portable food container according to claim 2, wherein said side-wall portion of the side cover has opposite side edges each partially linked with the right side wall of the box at a short unbroken portion, with the short unbroken portion torn or broken after first use of the box.

4. A portable food container according to claim 3, wherein said side cover is formed with a pulling tab adjacent to the right folding line between the side-wall portion and the top lid, whereby upon pulling of the tab, the side cover will be pulled sidewardly to open the box for easy access into the interior for taking foods outwardly.

5. A portable food container according to claim 4, wherein said pulling tab is directly cut out from the side cover to form a tab hole in the side cover.

6. A portable food container according to claim 1, wherein said side-wall portion of said side cover has a height which is defined between the hinge line and the right folding line of the side-wall portion and said height of said side-wall portion being half of a height of the right side wall.

* * * * *